US007322077B2

(12) United States Patent
Pederson

(10) Patent No.: US 7,322,077 B2
(45) Date of Patent: Jan. 29, 2008

(54) SHOE TIE SYSTEM

(75) Inventor: Kris Pederson, Edmonds, WA (US)

(73) Assignee: Kris A. Pederson, Shoreline, WA (US)

( * ) Notice: Subject to any disclaimer, the term of this patent is extended or adjusted under 35 U.S.C. 154(b) by 156 days.

(21) Appl. No.: 11/190,753

(22) Filed: Jul. 27, 2005

(65) Prior Publication Data

US 2007/0022585 A1 Feb. 1, 2007

(51) Int. Cl.
*A43C 3/00* (2006.01)
*A43C 3/02* (2006.01)

(52) U.S. Cl. ..... 24/713.5

(58) Field of Classification Search ..... None
See application file for complete search history.

(56) References Cited

U.S. PATENT DOCUMENTS 746,042 A * 12/1903 De Loach ..... 24/713.5
1,059,838 A * 4/1913 Collin ..... 24/713.5
1,393,188 A * 10/1921 Whiteman ..... 24/713.5
1,481,903 A * 1/1924 Hart ..... 24/712.6

* cited by examiner

*Primary Examiner*—Jack W. Lavinder

(57) ABSTRACT

The present invention relates to a shoe tie system and, more specifically, to a tie system capable of securing a shoe to a user's foot. The shoe tie system includes a mounting plate disposed for connecting to a shoe. The mounting plate has a first end and a second end and a pin is pivotally connected to the second end of the mounting plate. The first end of the mounting plate has an upper and lower end, between which a rotating apparatus revolvingly extends. A tie is disposed between the rotating apparatus and mounting plate and when the tie is pulled, the rotating apparatus revolves. The mounting plate and rotatable apparatus may each include bases having a plurality of notches. After pulling the tie, the notch located on the base of the rotatable apparatus connects with the notch of the mounting plate, thereby preventing further revolution of the rotatable apparatus.

1 Claim, 5 Drawing Sheets

SHOE TIE SYSTEM

BACKGROUND OF INVENTION

1. Field of Invention

The present invention relates to a shoe tie system and, more specifically, to a shoe tie system capable of securing a shoe to a user's foot.

2. Background of Invention

Shoes have been employed for centuries by individuals seeking to protect the soles of their feet from the ground. The first shoes are believed to be sandals, which were constructed from a variety of natural elements such as bark, leaves, and vines. As time passed, factors such as climate conditions and fashion trends resulted in the evolution of the sandal into more sophisticated types of footwear, including tennis shoes and high heels.

As shoes evolved, so did the ability to customize shoes for individual wearers. For example, shoes were made to custom fit the right and left feet of an individual. Further, shoes were modified to allow for different uses. High heels were created for elegant events and daily wear, while hiking boots provided traction footing for climbing over mountains and other physical impediments in nature.

Still further, shoes were manufactured such that they could be tightened to fit an individual's foot. Exemplary materials for tightening a shoe on an individual's foot included, but were not limited to materials such as velcro, buckles and hooks. However, by far, the most common material used to tighten a shoe on an individual's foot is the shoelace. Shoelaces are generally defined as thin cords fitted to shoes to prevent a shoe from inadvertently slipping off an individual's foot.

While shoelaces are commonly used to tighten a shoe on an individual's foot, it is an often time-consuming process to actually tighten a shoelace. Specifically, referring to FIG. 1, a shoe is generally equipped with a plurality of eyelets running up the left and right side of the front of a shoe. The shoelace is positioned within the shoe in what is commonly referred to as a "figure eight" position, which provides for a vertical set of bands running across the front of the shoe between corresponding left and right eyelets. In order to tighten the shoe on a foot, an individual must first tighten the shoelace on the lowest band. The individual must then tighten the shoelace on the next highest band. The individual must continue this process throughout the entire vertical band to properly tighten the shoelace on the individual's foot so that the shoe is accordingly tightened.

BRIEF SUMMARY OF THE INVENTION

The present invention relates to a shoe tie system and, more specifically, to a shoe tie system capable of securing a shoe to a user's foot.

The invention is directed to a shoe tie system including a mounting plate disposed for connecting to a shoe. The mounting plate has a first end and a second end and a pin is pivotally connected to the second end of the mounting plate. The first end of the mounting plate has an upper and lower end, and a rotating apparatus revolvingly extending between the upper and lower end. A tie is disposed between the rotating apparatus and the mounting plate such that when the tie is pulled, the rotating apparatus revolves.

The shoe tie system may further include the rotatable apparatus attaching to the mounting plate such that a slot is formed between the mounting plate and the rotatable apparatus. A tie is disposed in the slot such that when the tie is pulled, the rotatable apparatus revolves.

The mounting plate of the shoe tie system may also include a base having a plurality of notches, as well as a rotatable apparatus having a top and a bottom, the bottom of the rotatable apparatus having a plurality of notches. Upon completion of pulling the tie, a notch of the rotatable apparatus will connect with a notch of the mounting plate, thereby preventing further revolution of the rotatable apparatus.

A method for manufacturing a shoe tie system is also disclosed, the method including the steps of forming a mounting plate for attaching to a shoe, the mounting plate having a first end and a second end. The first end and the second end of the mounting plate are attached to the shoe with first and second mounting pins, and a rotatable apparatus is positioned within the mounting plate such that a slot is formed between the rotatable apparatus and the mounting plate. A tie may be thread through the slot.

Also disclosed is a method for tying a shoe, the method including fastening a plurality of mounting plates to the shoe. A rotatable apparatus is disposed within each of the plurality of mounting plates such that a slot is created between each of the rotatable apparatus and each of the mounting plates. A tie is thread through the slot, and as the tie is pulled, the rotatable apparatus revolves.

The foregoing and other objectives, features, and advantages of the invention will be more readily understood upon consideration of the following detailed description of the invention, taken in conjunction with the accompanying drawings.

BRIEF DESCRIPTION OF THE SEVERAL VIEWS OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE INVENTION

Figure 1:
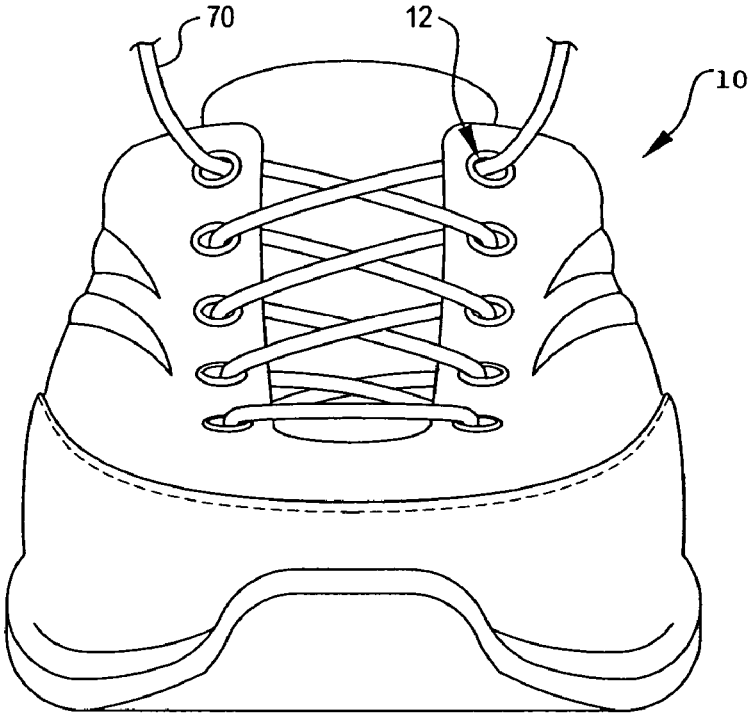
FIG. 1 PRIOR ART
FIG. 1. is a drawing showing a front perspective of an exemplary prior art shoe.

The present invention relates to a shoe tie system 100 and, more specifically, to a shoe tie system 100 capable of securing a shoe 10 to an individual's foot. As more specifically described below, and in accompanying FIGS. 2-8, the shoe tie system 100 allows for the simultaneous tightening of a shoe 10 on an individual's foot by pulling the shoelaces 70 of the shoe 10 through the shoe tie system 100.

FIGS. 2-8 detail an exemplary embodiment of the shoe tie system 100 including several variations thereof. Generally, the shoe tie system 100 includes a rotatable apparatus 20, a mounting plate 30, optional mounting pins 40, an optional click mechanism 50 and ties 70.

The mounting plate 30, as shown in FIGS. 2-8, is the mechanism by which the shoe tie system 100 of the present invention may be attached or incorporated as part of a shoe 10. The mounting plate 30 also provides an attachment mechanism for the rotatable apparatus 20. The shape of the mounting plate 30 should not be limited, and in fact, is likely to be altered, reshaped and modified to accommodate the style and size of different shoes.

Figure 2:
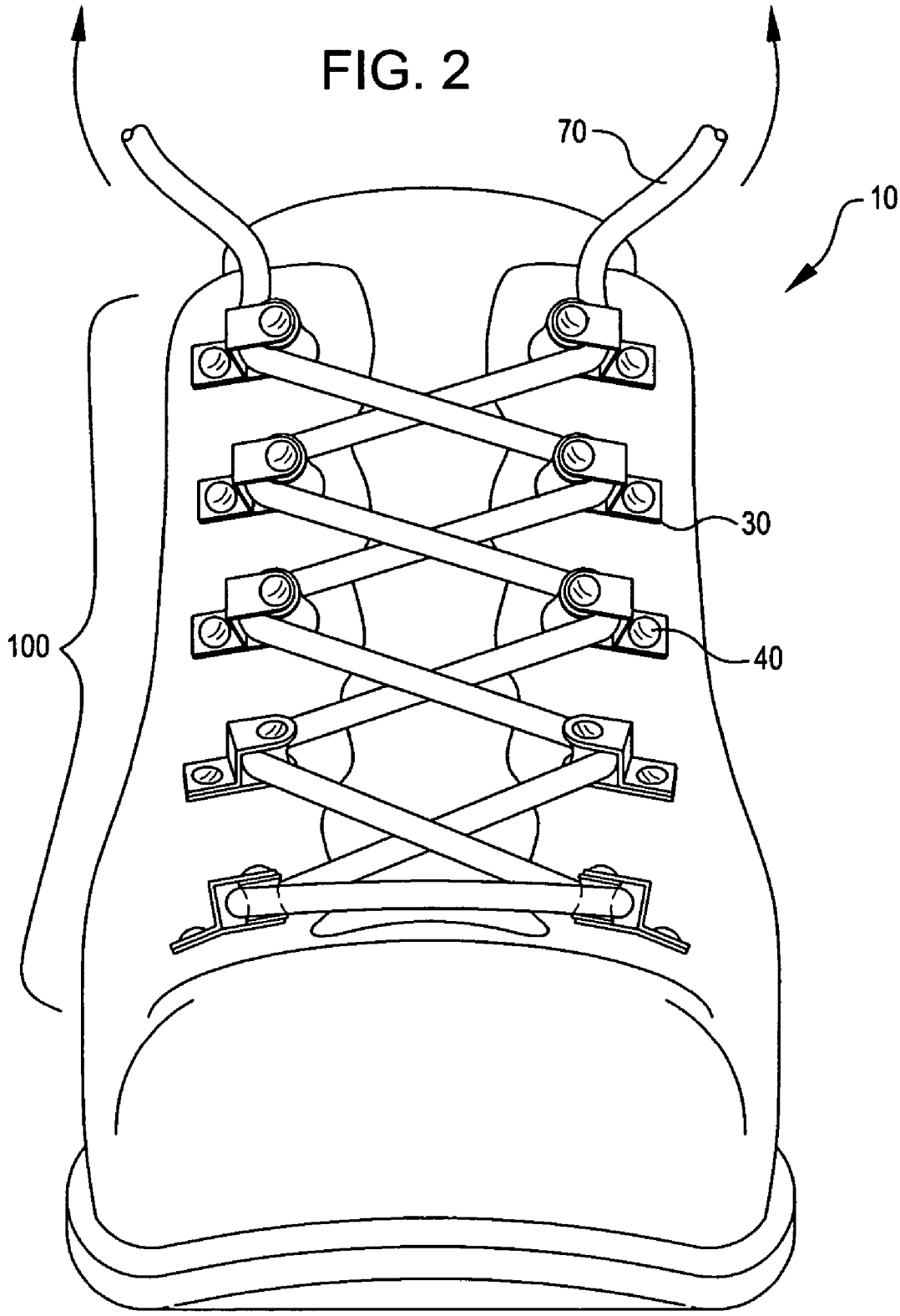
FIG. 2 is a drawing showing a front perspective view of a shoe employing a first exemplary embodiment of the shoe tie system of the present invention.
Figure 3:
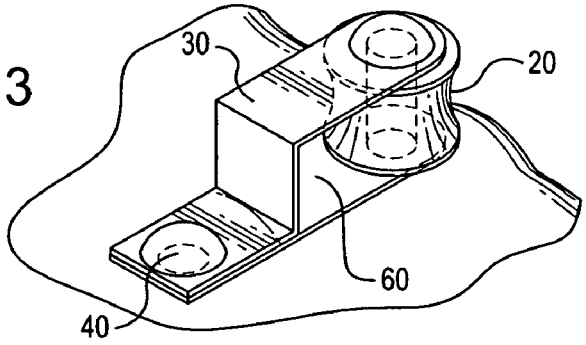
FIG. 3 is a drawing showing an exploded view of a rotatable apparatus employed in connection with the exemplary embodiment of the shoe tie system shown in FIG. 2.
Figure 4:
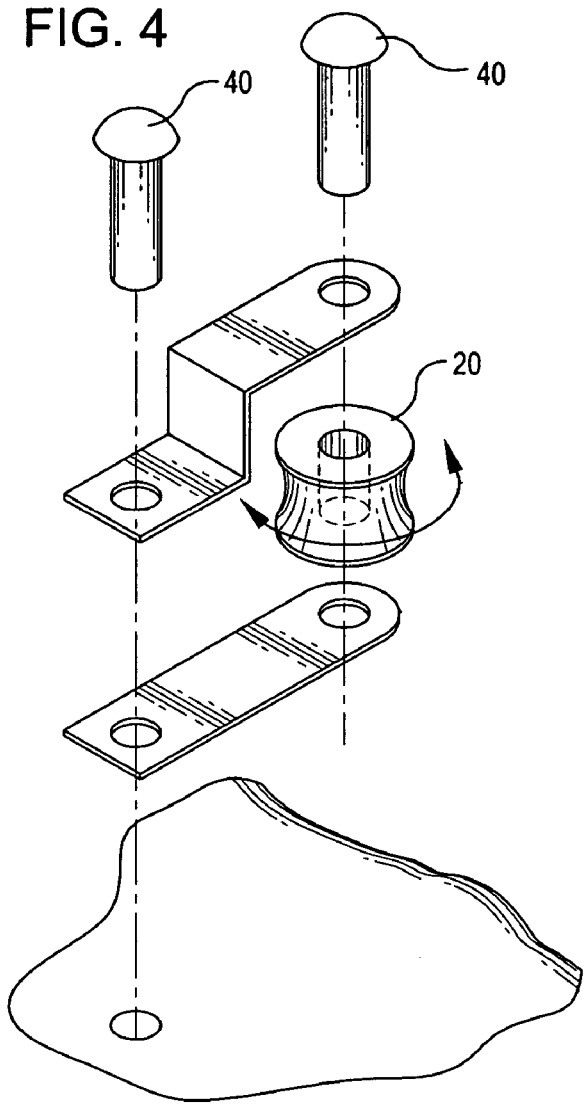
FIG. 4 is a drawing showing the exemplary configuration of the rotatable apparatus employed in connection with the exemplary embodiment of the shoe tie system shown in FIG. 2.

In some cases, the mounting plate 30 may have first and second ends, as shown in FIGS. 2-4. The first and second ends provide additional mechanisms by which the mounting plate 30 may be attached to the shoe 10, thereby increasing the structural rigidity of the mounting plate 30 as well as the strength of the shoe tie system 100.

Figure 6:
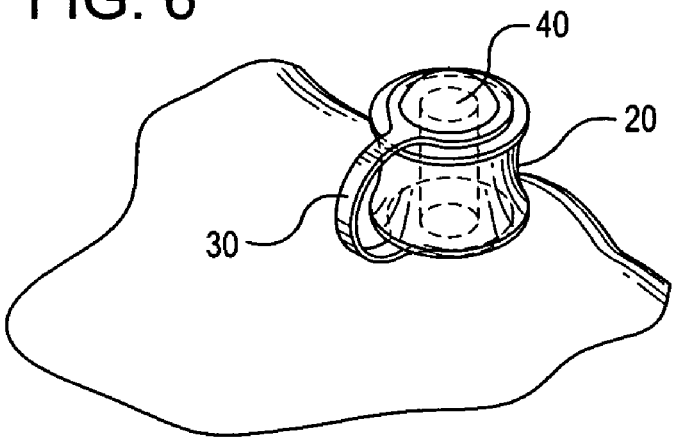
FIG. 6 is a drawing showing an exploded view of a rotatable apparatus employed in connection with the exemplary embodiment of the shoe tie system shown in FIG. 5.
Figure 7:
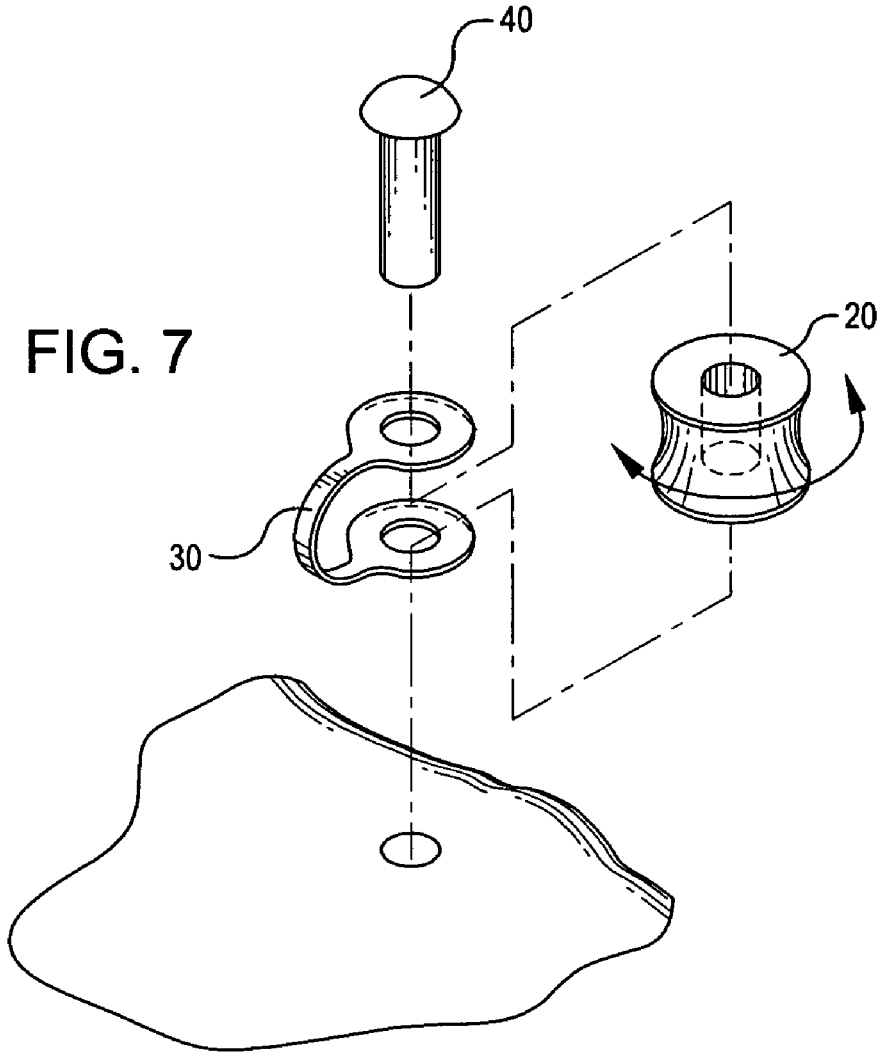
FIG. 7 is a drawing showing the exemplary configuration of the rotatable apparatus employed in connection with the exemplary embodiment of the shoe tie system shown in FIG. 5.

In other cases, and as shown in FIGS. 6-7, a mounting plate 30 with an attachment mechanism attaching the mounting plate 30 to the shoe 10 in only one location, allows for a more compactly constructed mounting plate 30, which reduces the weight of the mounting plate 30 and provides a lighter and smaller shoe tie system 100. Further, a mounting plate 30 integrally formed as part of a shoe 10 allows for a compact shoe tie system 100 that does not require alteration or modification of the shoe 10.

There are a number of different mechanisms by which the mounting plate 30 may be attached or incorporated as part of a shoe 10. For example, and as shown in FIG. 2, the mounting plate 30 is attached to a shoe 10 by two mounting pins 40. The purpose of the mounting pins 40 is to bind the mounting plate 30 to the shoe 10. While the number and configuration of the mounting pins 40 may be modified to accommodate the size and shape of an individual shoe 10, one example of placement of the mounting pins 40 is illustrated in FIG. 2, wherefore a first and second mounting pin 40 affix the mounting plate 30 to the shoe 10 at a first and second location. In other cases, the mounting plate 30 is attached to a shoe 10 with at least one mounting pin 40.

Figure 5:
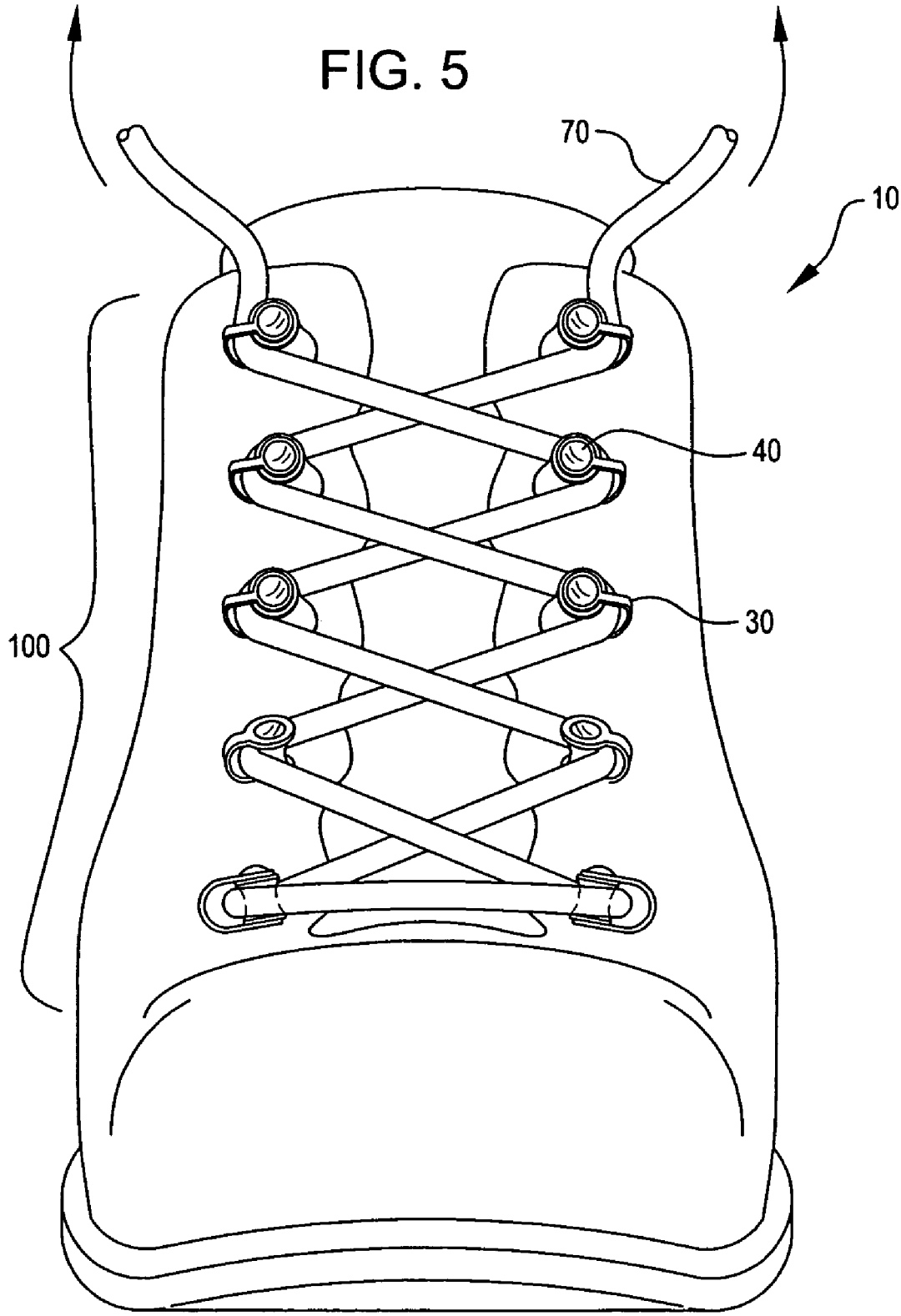
FIG. 5 is a drawing showing a front perspective view of a shoe employing a second exemplary embodiment of the shoe tie system of the present invention.

In another case, the mounting plate 30 may be manufactured to simply insert in the pre-formed eyelet 12 of a shoe 10 to improve the efficiency by which a user may attach the shoe tie system 100 to a shoe 10. FIG. 5 shows an exemplary embodiment wherein the mounting plate 30 is connected directly to an eyelet 12 of a shoe 10 using a mounting pin 40. The mounting pin 40 serves to directly bind the mounting plate 30 to the shoe 10, thereby avoiding the destruction or alteration of the shoe 10.

In other cases, the mounting plate 30 may be manufactured as a part of the shoe 10, which will allow an individual to purchase a shoe 10 with the shoe tie system 100 already implemented in the shoe 10. This removes any necessity by an individual to alter or modify the shoe 10 to incorporate the shoe tie system 100.

As used herein, the term "mounting pin" 40 is shown as a bolting mechanism that affixes the mounting plate 30 to the shoe 10. However, for purposes of the shoe tie system 100, the mounting pin 40 may be any mechanism that binds the mounting plate 30 to the shoe 10. Exemplary mounting pins 40 may include but are not limited to a snap connection mechanism, hook and loop mechanism, or a hook and wing mechanism.

Attached to the mounting plate 30 is a rotating apparatus 20. The purpose of the rotating apparatus 20 is to provide the mechanism by which a tie 70, which is further discussed in detail below, is transposed through the shoe tie system 100.

The rotating apparatus 20 may be connected to the mounting plate 30 in a variety of ways. In one case, as shown in FIGS. 3 and 4, the mounting plate 30 includes a first end and a second end. The second end of the mounting plate 30 is directly connected to the shoe 10 via a mounting plate 30, while the first end of the mounting plate 30 has an upper and lower end. Affixed between the upper end and the lower end of the first end of the mounting plate 30 is the rotating apparatus 20. As shown in FIG. 4, a mounting pin 40 is affixed directly between the upper end of the mounting plate 30, the center of the rotating apparatus 20, the lower end of the mounting plate 30, and the shoe 10, although in other cases, the mounting pin 40 may simply affix directly between the upper end of the mounting plate 30, the center of the rotating apparatus 20 and the lower end of the mounting plate 30.

Formed between the mounting plate 30 and the rotating apparatus 20 is a slot 60. The purpose of the slot 60 is to provide a location wherein the tie 70 is positioned. Exemplary embodiments of the slot 60 are shown in FIGS. 3-4 and FIGS. 6-7.

In optional cases, the shoe tie system 100 involves fabrication of the rotating apparatus 20 and the mounting plate 30 to form a click mechanism 50. The purpose of the click mechanism 50 is to prevent the rotating apparatus 20 from revolving after an individual has stopped pulling on the tie 70.

Figure 8:
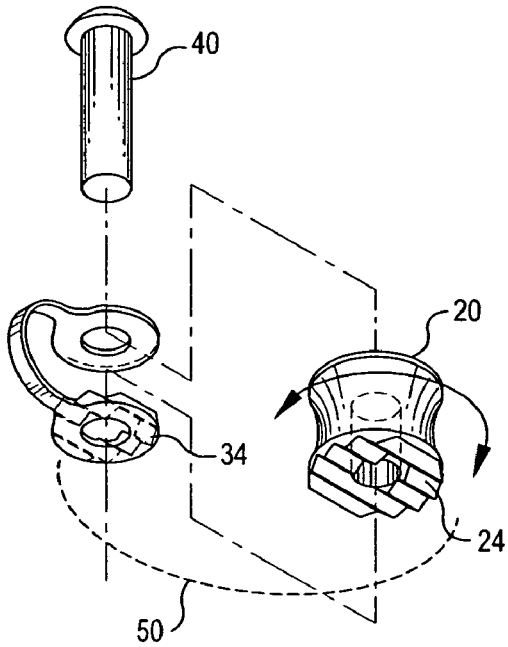
FIG. 8 is a drawing showing an exploded bottom view of an optional rotatable apparatus including a click mechanism 50 which may be employed in connection with the exemplary embodiment of the shoe tie system shown in FIG. 5.

As shown in FIG. 8, in some cases, the click mechanism 50 includes a mounting plate 30 having a base. The base includes a plurality of notches, indentations or raised points ("notches") 34. Similarly, the rotating apparatus 20 includes a base having a plurality of notches, indentations or raised points ("notches") 24. Preferably, the notches 34 of the base of the mounting plate 30 are in opposite functionality with the notches 24 of the rotating apparatus 20. Specifically, if the base of the mounting plate 30 includes a plurality of indentations, the base of the rotating apparatus 20 would include a plurality of raised points. When the rotating apparatus 20 is revolved, the plurality of notches 34 located on the base of the mounting plate 30 and the plurality of notches 24 located on the rotating apparatus 20 are forced past each other due to the force exerted by a user pulling on the ties 70. However, when the pulling is stopped, the notches 34 of the mounting plate 30 intersect with the notches 24 located on the mounting plate 30, thereby preventing any further revolutions of the rotating apparatus 20.

Shoelaces 70 are commonly known in the industry, and for purposes of this detailed description, are referred to interchangeably with the term "tie" 70. Various types of ties 70 can be used in connection with the shoe tie system 100, and nothing set forth herein or in the drawings should limit the type of ties 70 to be used in connection with the shoe tie system 100, all of which are well known to those of ordinary skill in the art. Exemplary materials for ties 70 include leather, chord and elastic.

In use, at least one mounting plate 30 and at least one rotating apparatus 20 are affixed to the shoe 10 in any manner set forth in the detailed description and accompanying drawings. The shoe tie 70 is then disposed within the slot 60 between each of the plurality of rotating apparatuses 20 and mounting plates 30 in a figure eight configuration, as shown in FIG. 2, and as commonly known in the industry. After the shoe tie 70 has been disposed within each of the slots 60, the individual is provided with a first and second tie end. The individual then pulls on the first and second tie end, which in turn pulls the tie 70 through the plurality of slots 60. As the tie 70 is pulled through the plurality of slots 60, the rotating apparatus 20 corresponding to each slot 60 rotates, which in turn, provides for the convenient and simultaneous tightening of the shoe 10 on the user's foot.

It should be understood that the present invention encompasses a shoe tie system 100 that can be adjusted for shoes 10 to fit on an individual's right or left foot. Moreover, while this detailed description is directed to and describes a shoe tie system 100 intended for large footwear items, such as construction boots, construction of similar shoe tie systems for smaller or larger footwear items would be practicable and nothing in this detailed description should limit the size of the shoe tie system 100 or use of the present invention with footwear items.

Other advantages and details about the shoe-tie system 100 of the present invention are detailed in FIGS. 2-8.

The terms and expressions that have been employed in the foregoing specification are used as terms of description and not of limitation, and are not intended to exclude equivalents of the features shown and described or portions of them. The scope of the invention is defined and limited only by the claims that follow.

What is claimed is:

1. A shoe tie system for allowing the simultaneous tightening of a shoe on an individual's foot by pulling a shoelace through the shoe tie system comprising:

a plurality of tie receiving devices wherein each device includes a mounting plate for connecting to a shoe, said plate includes a first end and a second end, a mounting pin connected to said second end of the mounting plate for securing the device to the shoe, and a rotating apparatus mounted on a pin extending between an upper and lower end of said first end of the mounting plate, said rotating apparatus including a plurality of notches located on the bottom of the apparatus for mating with a plurality of notches located on the lower end of the first end of the mounting plate opposite the notches located on the bottom of the rotating apparatus, these notches allow the rotating device to rotate in a first direction and then lock the rotating device into a position to prevent the device from rotating in an opposite direction, a tie disposed through the tie receiving devices between the rotating apparatus and the mounting plate of each tie receiving device, wherein when the tie is pulled, the rotating apparatuses rotate in a first direction allowing the tie to tighten the shoe about the user's foot, once the tie is released or tied into a knot, the notches on the rotating apparatus and on the mounting plate lock the rotating apparatus into a position to prevent the rotation of the apparatus in a second direction opposite to the first direction of rotation.

* * * * *